United States Patent [19]

Ffooks

[11] Patent Number: 4,459,929

[45] Date of Patent: Jul. 17, 1984

[54] TANKS FOR THE STORAGE AND TRANSPORT OF FLUID MEDIA UNDER PRESSURE

[75] Inventor: Roger C. Ffooks, London, England

[73] Assignee: Ocean Phoenix Holdings N.V., Netherlands Antilles

[21] Appl. No.: 447,962

[22] Filed: Dec. 8, 1982

[30] Foreign Application Priority Data

Dec. 16, 1981 [GB] United Kingdom ..... 8137977

[51] Int. Cl.[3] ..... B63B 25/08

[52] U.S. Cl. ..... 114/74 A; 220/901

[58] Field of Search ..... 114/74 R, 74 A, 74 T; 220/1 B, 901, 445

[56] References Cited

U.S. PATENT DOCUMENTS

| | | | |
|---|---|---|---|
| 3,314,567 | 4/1967 | Becker et al. | 114/74 A |
| 3,459,148 | 8/1969 | Progler | 220/901 |
| 3,645,415 | 2/1972 | Phelps | 220/1 B |

FOREIGN PATENT DOCUMENTS

| | | | |
|---|---|---|---|
| 2124037 | 9/1972 | France | 114/74 A |

*Primary Examiner*—Trygve M. Blix

*Assistant Examiner*—Jesûs D. Sotelo

*Attorney, Agent, or Firm*—Hayes, Davis & Soloway

[57] ABSTRACT

The tank is a modified form of the lobed tank described in British Pat. No. 1522609, whereby the tank ends are of simpler constructional form. Thus, the tank comprises, top, bottom and two opposed side walls (1 to 4) each consisting of parallel, part-cylindrical lobes (11) which are connected and tied together by tie-plates (13, 14) and elongated armed insert elements (16, 17 and 17*a*). The invention is characterized in that each one of said other two opposed side walls (5, 6) comprises at least two part-lobes (11*c*) which present straight edges to which the common straight end edges of a series of two-way corner transition (12*c*) and part-transition (12*d*) pieces are joined, and in that the end of each part-lobe (11*c*) has a respective part-transition piece (12*d*) joined thereto to present a curved edge to which a part-spherical three-way corner (12*b*) can be joined to close-off the side wall (5 or 6). Preferably, the transition and part-transition pieces are joined together via elongate curved insert elements (12*e*) in which there is a smooth transition from being of generally "Y" cross-section at one end to "T" cross-section at the other end.

5 Claims, 12 Drawing Figures

TANKS FOR THE STORAGE AND TRANSPORT OF FLUID MEDIA UNDER PRESSURE

This invention relates to tanks for the transport and storage of fluid media under pressure. More particularly, it is concerned with tanks or ships or barges for the transport in bulk by sea of a liquefied gas preferably at a pressure, which is above atmospheric pressure.

A most effective way of containing bulk fluid under pressure is the use of a tank geometry which places most if not all of the containing material in tension rather than in bending. The simplest example of this is a spherical tank. However, the overall space available for the containment is likely to be of rectangular cross-section. In the case of ocean transport, for example the space within a ship's hull makes it very desirable for economy of installation, both in terms of cost and space, that such tanks should be of approximately rectangular enveloping form, rather than spherical.

There have been a number of prior proposals for producing a tank of more or less rectangular form that nevertheless has all its significant regions subjected to tensile rather than bending stresses, in which the walls are lobed, or built up of part-circular sections. However, in general, the prior proposals have been concerned with containment at atmospheric pressure rather than at superatmospheric pressure.

One prior proposal for such a tank and for containment at superatmospheric pressure is described and claimed in our British Patent Specification No. 1,522,609. In this proposal an internal-pressure-sustaining insulatable elongate tank for the storage and transport of fluid media under pressure, comprises a bottom wall, a top wall, two opposite longitudinal side walls and two opposite end walls, an internal framework of plates and bottom supports and top supports; each of said bottom, top and side walls consisting of a multiplicity of equal-sized lobes each lobe of part-cylindrical form having an arc in the range of 50° to 90° and being convex outwardly of the tank with each of its two inwardly-directed edges joined to both an edge of a lobe alongside and an edge of a plate of said internal framework, each of said end walls consisting of a multiplicity of equal-sized convex end wall elements having the same radius of curvature of said lobes and each joined at its inwardly directed edges to the end wall elements alongside and to plates of said internal framework; tank corner elements being provided to unite said bottom, top, side and end walls to one another said corner elements being convex and of the same radius of curvature as said lobes but with larger arcs; said internal framework consisting of two intersecting series of plates each plate in one series extending from the joint between two lobes of one side wall to the respective opposite joint of the opposite side wall, each plate in the other series extending from the joint between two lobes of the bottom wall to the respective opposite joint between two lobes of the top wall, and the plates of at least one of said series extending longitudinally of the tank and being also united to the joints of the opposite ends walls so that the tank end walls are tied to one another longitudinally; the joints at the intersections of the two series of plates being formed by cruciform section insert elements with the end edges of the four arms of the cruciform welded to respective plates, the joints between the bottom wall lobes and the plates in the internal framework being formed by bottom insert elements with vertical top arms and downwardly drooped side arms, the side arms being welded to respective bottom wall lobes and top arms being welded to the respective internal plates, the joints between the side wall lobes and the plates of the internal framework being formed by Y-section insert elements with the arms thereof welded to the respective side wall lobes and internal plates, and the joints between the top wall lobes and the plates of the internal framework being formed by top insert elements with vertical bottom arms and upwardly inclined side arms, the side arms being welded to the respective top wall lobes and the bottom arms being welded to the respective plates, and wherein said bottom supports are located directly under the joints between adjacent bottom lobes of the tank and support the tank with space below the lowermost parts of the bottom wall lobes and said top supports are located directly above joints between adjacent top lobes of the tank.

In a preferred embodiment of this prior proposal, the end walls of the tank comprise square-based domes and at the corners and edges of the tank, where the lobes forming the sides, top and bottom meet such end walls, part-spherical knuckles with the same radius of curvature as the lobes are provided in order to effect transition from the lobes of the longitudinally extending walls to the domes of the end walls with the tank plates meeting tangentially at all junctions.

Also, in the preferred embodiment the lobes of the longitudinal side walls run longitudinally from one end of the tank to the other so that the tunnels defined by the intersecting tie-plates are horizontal, either longitudinal or transverse. Other features and the advantages of such a tank construction are described and discussed in detail in our said British Patent Specification.

However, it has been found difficult with such a construction of end wall to joint the inwardly directed edges of adjacent tank domes together, particularly at common corners where four adjacent domes meet. Thus, these locations may each require a corner insert element with a multiplicity of arms so that all four corners may be joined together, as well as adjacent intersecting horizontal tie-plates, and perhaps vertical tie-plates. With such a construction, it will be appreciated that there is a requirement for a very complicated corner insert element, and a particularly careful procedure for aligning the component parts, welding the parts together, and subsequently checking the quality of the welds.

An object of the present invention is to provide a modified form of elongate tank described and claimed in our said British Patent Specification No. 1,522,609, in which the tank ends are of simpler form from the point of view of their construction.

According to the present invention an internal-pressure sustainable tank for the storage and transport of fluid media under pressure comprises, as known per se, a bottom wall, a top wall, four side walls and an internal framework of plates; each of said bottom, top and two opposed side walls consisting of at least two longitudinally extending parallel lobes each lobe being of part-cylindrical form with the same radius of curvature and being convex outwardly of the tank with each of its two inwardly-directed longitudinal edges joined to both a longitudinal edge of a lobe alongside and an edge of a plate of said internal framework; the latter consisting of two orthogonally intersecting series of parallel plates each plate in one series extending from the joint between two lobes of one of said opposed side walls to the respective opposite joint to its opposite side wall, each plate in the other series extending from the joint between two lobes of the bottom wall to the respective opposite joint between two lobes of the top wall, and the plates of at least one of said series extending longitudinally and being also united to oppositely arranged joints of wall components of the other two opposed side walls so that these latter walls are tied to one another longitudinally; the joints at the intersections of the two series of plates, the bottom wall lobes and adjacent plates, the top wall lobes and adjacent plates, and the side wall lobes and adjacent plates being formed by elongate insert elements with an appropriate number of arms arranged at appropriate angles, and is characterised in that each one of said other opposed walls (preferably end walls) comprises at least two part-lobes of the same radius of curvature, but of appreciably smaller arc than the lobes of said opposed side, top and bottom walls, which part-lobes present straight edges to which the common straight end edges of a series of two-way corner transition and part-transition pieces are joined, these latter pieces having the same radius of curvature as the lobes at their other end edges and being joined at said other ends to respective lobes of an appropriate one of said opposed side walls (preferably longitudinally extending walls), and in that the end of each part-lobe has a respective part-transition piece joined thereto to present a curved edge to which a part spherical three-way corner can be joined to close-off the end wall.

Preferably each one of said other exposed side walls (end walls) comprises one or more further lobes equal in number to the number of intermediate lobes forming either said opposed side walls (longitudinal walls), or the top and bottom walls, said further lobes being of the same radius or curvature and arc as the other wall lobes and being joined with a first set of two-way corner pieces, which are in the form of part-spherical knuckles, to corresponding lobes of said opposed side walls, or the top and bottom walls, so that at least one band of lobes and further lobes extends around the tank in the horizontal or the vertical plane, and in that said two part-lobes are joined along each outer edge of said further lobe, or series of further lobes, the transition and part-transition pieces thereby forming a second set of two-way corner pieces.

Preferably, the transition and part-pieces are joined together via elongate curved insert elements in which there is a smooth transition from being of generally "Y" cross-section at one end to "T" cross-section at the other end.

In order that the invention may be readily understood, and further features made apparent, two embodiments of cargo tank and a support system therefor will now be described, with reference to the accompanying drawings in which.

Figure 2:
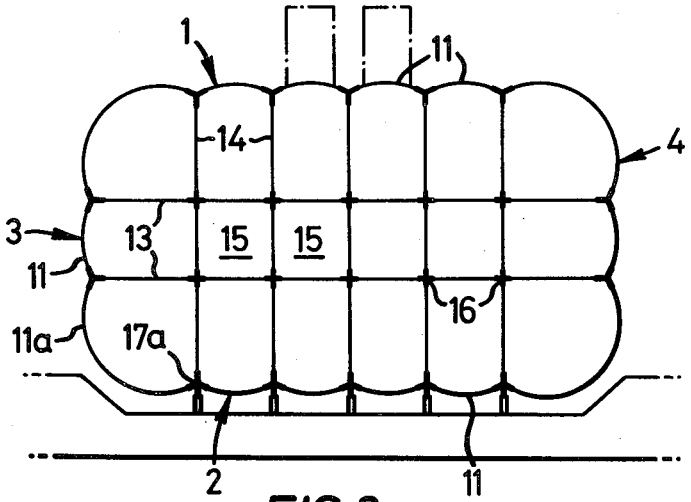
FIG. 2 is a transverse section through the cargo tank.
Figure 8:
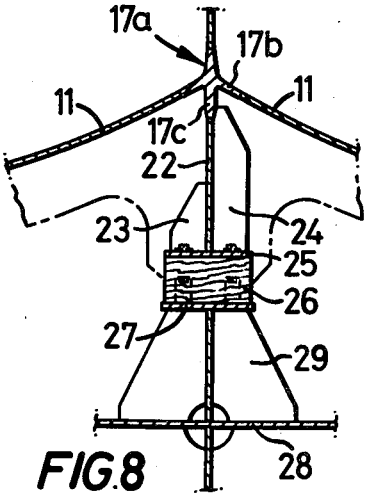
Figure 12:
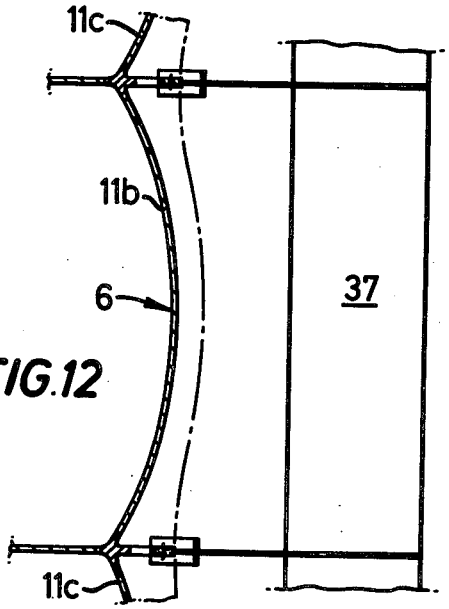
Figure 7:
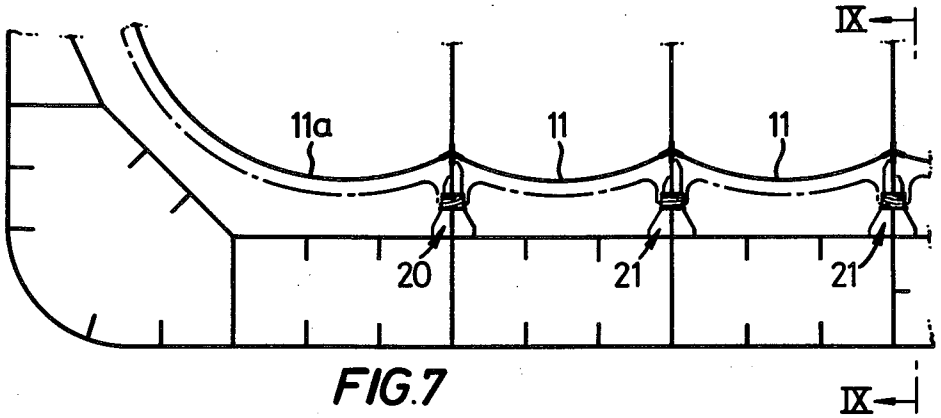
Figure 9:
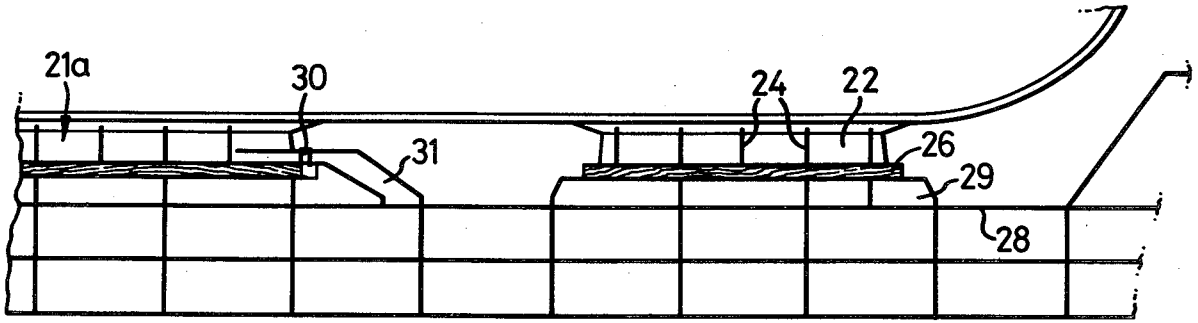
Figure 10:
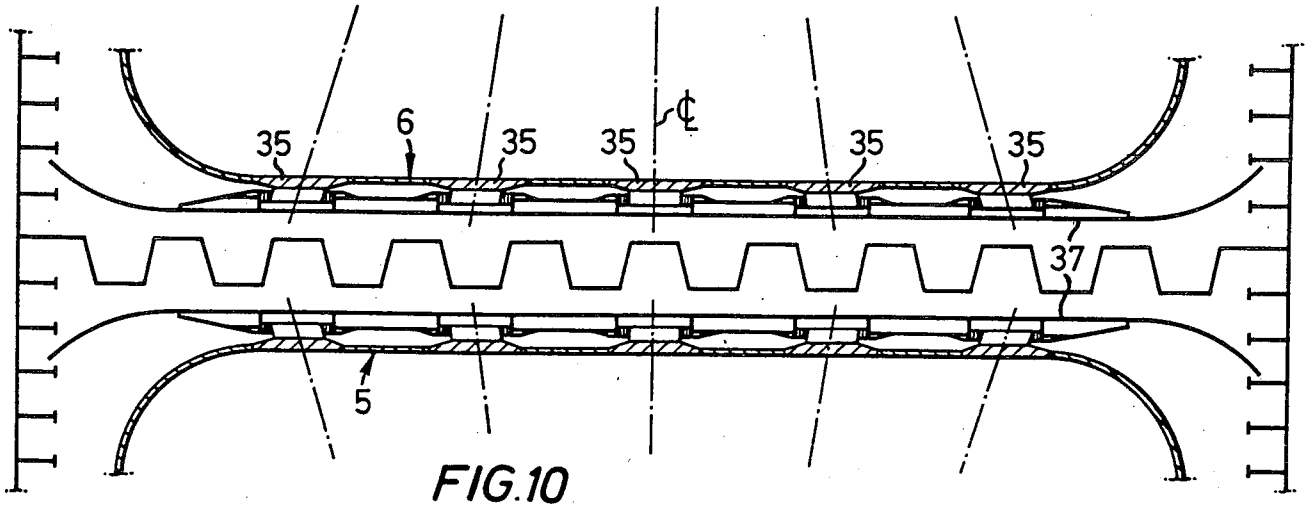
Figure 11:
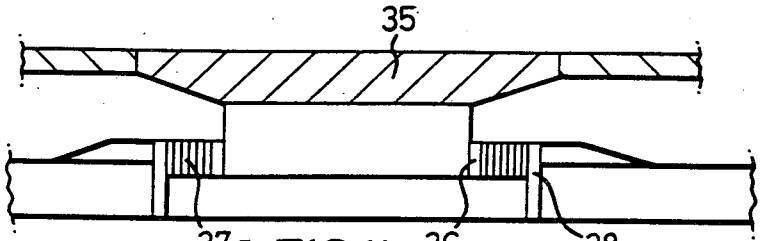

FIG. 7 is a typical transverse section through an ocean-going tanker showing the preferred bottom support system for the cargo tank as shown in FIG. 2, FIG. 8 is an enlarged detail of FIG. 7, FIG. 9 is a part-longitudinal section on the line IX—IX of FIG. 7, FIG. 10 is a sectional plan view of two adjacent holds of an ocean-going tanker showing a roll-keyway arrangement for the cargo tanks therein, FIG. 11 is an enlarged detail of a centre-line roll key, and FIG. 12 is a part elevation of a tank-end of FIG. 10.

Referring firstly to FIGS. 1 to 5, in a first embodiment, the tank shown is intended for installation in a tanker for the transport in bulk of liquified petroleum gas such as butane and propane, petrochemicals, and ammonia at a pressure from atmospheric up to approximately 5 atmospheres absolute. When installed in the tanker, the tank will be one of a series accommodated in hold spaces of the hull e.g. as partly shown in FIG. 10. However, the same tank construction can be employed for terminal storage onshore or in barges.

The tank may be of special steel selected according to the required operating temperature, e.g. 9% nickel steel for LGN, or low carbon mild steel for LPG, and has a generally rectangular cross-section. The shell of the tank comprises top, bottom and longitudinal sidewalls 1 to 4 respectively composed of outwardly convex, part-cylindrical parallel lobes 11, 11*a*, extending horizontally from end to end of the tank. Although in the tank shown there are only six lobes across the width and three in the depth of the tank, it is to be understood that there could be any number of lobes appropriate to the overall dimensions of the tank. For example, in the second embodiment of the tank shown in FIG. 6, there are only four lobes across the width of the tank and two in the depth. The intermediate (two-way) corner lobes 11*a* have much larger arcs of about 150° in order to join the side walls 3, 4 of the tank to the top and bottom walls 1, 2. The end walls 5, 6 of the tank are each composed of one further lobe 11*b*, two part-lobes 11*c*, two-way and three-way part-spherical knuckes 12*a* and 12*b* respectively which terminate respective intermediate lobes 11 and part of the corner lobes 11*a* of the side walls 3 and 4 at the tank ends, eight two-way transition pieces 12*c* which terminate the intermediate lobes 11 of the top and bottom walls 1 and 2, and four two-way part-transition pieces 12*d* which with the adjacent three-way part spherical knuckle 12*b* terminate the corner lobes 11*a*. All the lobes, part-lobes, and part-spherical knuckles have the same radius of curvature; and in the tank shown, the module size, that is to say the chord length of each lobe (except the corner lobes) is the same in all four longitudinal walls.

Figure 1:
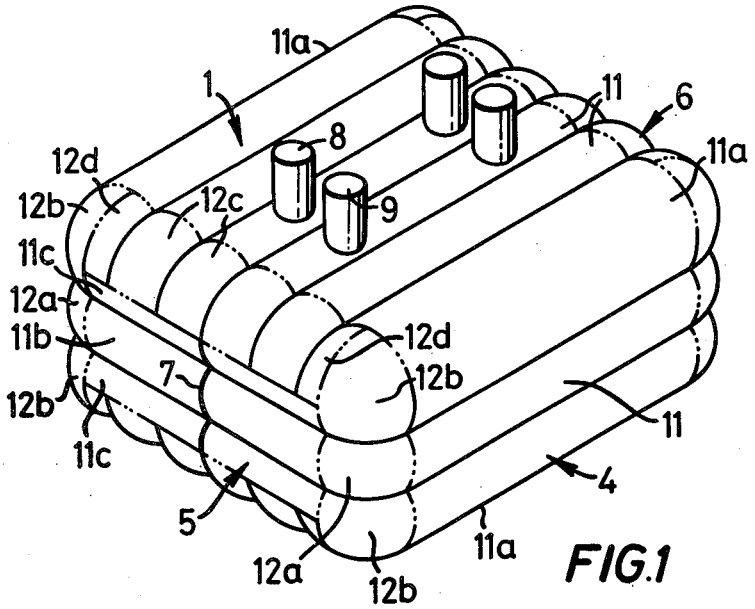
FIG. 1 is an isometric view of a first embodiment of cargo tank.

As shown particularly in FIG. 1, the end walls 5, 6 are completed by welding the further lobes 11*b* via the two-way corner knuckles 12*a* to the intermediate lobes 11 of the side walls 3 and 4 so that an endless lobe band is provided horizontally around the tank. The two part-lobes 11*c*, which are approx. half of the arc of the intermediate lobes 11 and 11*b* (viz. approx. 30°) are each joined along an inwardly directed edge of the lobe 11*b*, and each presents a straight edge to which the two-way transition and part-transition pieces 12*c*, and 12*d* are welded. These pieces are joined at one end to the lobes 11, where they have the same radius of curvature as their respective lobes, but flatten out in a smooth transition to present straight edges at their other ends for joining to respective straight edges of the part-lobes 11*c*. The transition and part-transition pieces are joined together by welding via suitable curved elongate joining elements 12*e* (see FIG. 5) in which there is a smooth transition from being of "Y" cross-section at one end (corresponding to the end where the pieces join to the lobes 11 and 11*a*) to a "T"-section at the other end. The ends of the part lobes 11*c* and their respective part-transition pieces 12*d* present a curved edge to which the respective part-spherical knuckle 12*b* is joined to close-off the three-way corners of the tank.

Figure 6:
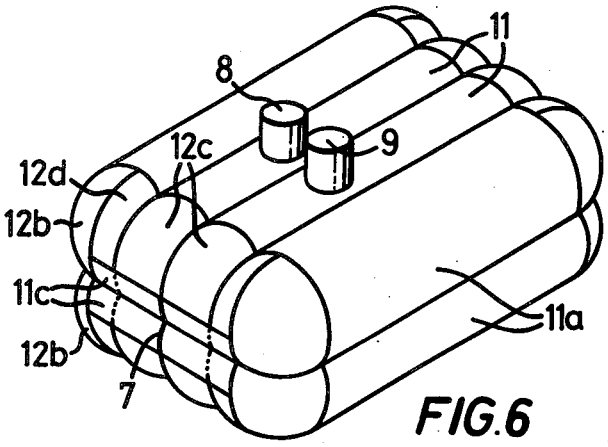
FIG. 6 is an isometric view of a second embodiment of cargo tank.

As mentioned hereinbefore, the second embodiment of tank shown in FIG. 6 differs from the first embodiment only in the number of lobes provided. It will be seen that by being only two lobes in depth no band of horizontally extending intermediate lobes 11, and 11*b* is provided. Instead, the two-part lobes 11*c* of the end walls are joined directly together. Otherwise, the use of transition and part-transition pieces 12*c* and 12*d* and the three-way corner knuckles 12*b* is identical.

The tanks described above are preferably fitted in their respective hold spaced with their end walls extending transversely of the tanker, in which case the tanks are provided with an externally longitudinally extending centreline bulkhead as indicated by the thicker line 7 in FIGS. 1 and 6.

Although the first tank embodiment has been described as shown in FIG. 1 with one horizontally extending band of lobes 11 and further lobes 11*b*, it will be appreciated that the tank could also be constructed with one or more such bands in the vertical plane. However, with the tank constructed as described above, the form of the end walls 5 and 6 is particularly suitable for the roll key/keyway arrangement described hereinafter.

At the intersection lines of the lobes, that is to say the 'nodes' between consecutive lobe arcs, internal tie-plates are fitted in horizontal and vertical sets 13,14, see FIG. 2, running longitudinally of the tank and thereby dividing the tank interior into a multiplicity of longitudinally-extending cells or square tunnels 15. The complete structure is welded at every intersection and at every inter-lobe node, so that the side walls are tied across laterally and the top and bottom walls are tied together vertically. Also, the internal plates are joined at their ends to the inter-lobe nodes of the end walls so that the ends of the tank are likewise tied together longitudinally. The axial passages formed by the internal tunnels must be interconnected, for fluid flow during loading and discharge of the tank, for purging of vapors, and other reasons, and this is achieved by providing oval or otherwise rounded openings near the ends of all the tie-plates 13, 14 at regions where the principle stresses fall off to a minor stress so that the openings may require no compensation. In the vertical plates, openings may be provided at the tops and bottoms of the plates. However, no openings would be provided in the liquid tight centreline bulkhead 7. For maintenance and servicing of the tank, sealable manholes 8 and 9 are provided on either side of the bulkhead 7.

Figure 3:
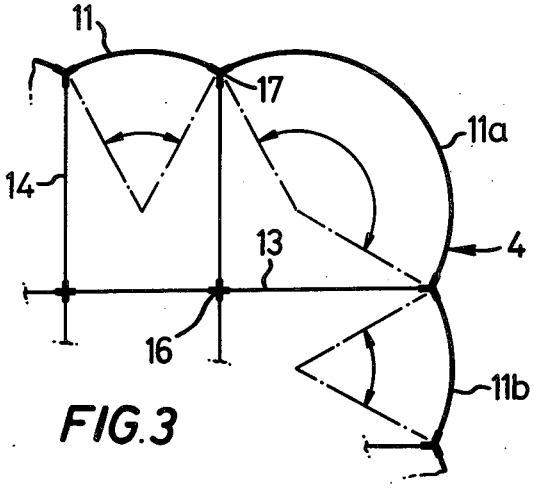
FIG. 3 is an enlarged sectional detail of FIG. 2.
Figure 4:
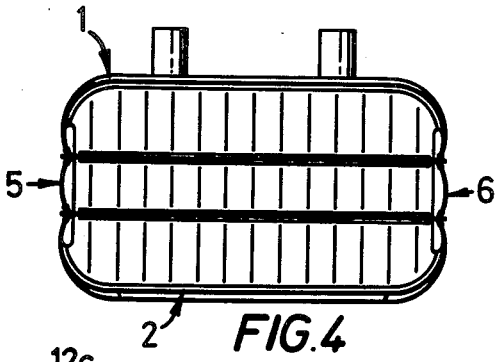
FIG. 4 is a longitudinal section through the cargo tank.
Figure 5:
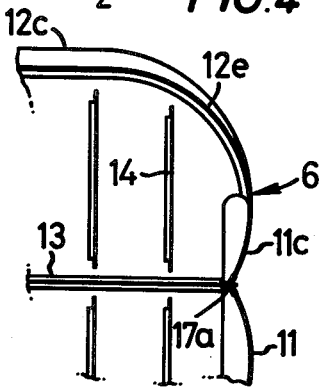
FIG. 5 is an enlarged sectional detail of FIG. 4.

FIGS. 3 and 5 show the manner of fabrication of the tank structure. At the intersections of the horizontal and vertical internal tie-plates 13, 14 the joints are made by welding in joint pieces 16 of cruciform cross-section. Insert pieces 17 of generally Y-cross-section are used to make welded joints between the tie-plates and lobes 11 of the tank walls. Where external tank supports are to engage the tank at the inter-lobe nodes, as hereinafter described, cruciform inserts 17*a* are used in place of the Y-inserts 17, and, considering the bottom cruciform insert pieces for instance, (see particularly FIG. 8) the lateral arms 17*b* of the cruciform inserts 17*a* are drooped to the same angular positions at the arms of the Y-inserts 17, so as to match the ends of the lobe arcs. The construction shown allows free access to both sides of all welds, ensuring 100% weld penetration without backing plates and facilitating subsequent radiographic inspection of the welds.

As already stated, the internal plates extend to the intersection lines or nodes at the tank ends and it is essential that the internal staying extend continuously from one end of the tank to the other in that manner. Thus, the construction of the tank allows all pressures to be borne by tensile loads in the shell plating of the tank and in the internal staying structure.

The weight of a tank constructed as described above can be substantially less than that of a conventional spherical or cylindrical tank for the same pressure and of the same capacity. In the present construction the loading is sustained by the internal structure whereas in a conventional tank it is sustained by the shell. It will be appreciated here that, the smaller the radius of the lobes and knuckles, the thinner can be the shell plating. A great advantage in having thinner plating is that the depths of the welds required to build the tank are reduced. Such a tank construction provides sufficient strength and stiffness in the longitudinal direction to be free-standing and supported from the bottom without imposing substantial bending loads on the tank.

FIGS. 7 to 9 of the drawings show a bottom support for the tank of FIGS. 1 to 5.

Referring to FIG. 7, it will be noted that longitudinally extending supports are provided at each node point between the bottom wall lobes 11*a*, 11. The two outermost supports 20 (viz at the node point between each corner lobe 11*a* and outermost intermediate lobe 11) run continuously over the entire length of the tank, whilst the other supports 21 are discontinuous, in that they comprise a number of short aligned support sections. Such an arrangement has the advantage that the central support sections of the discontinuous line of supports 21 can be used to restrict longitudinal sliding movement of the tank as discussed hereinafter. The construction of the supports 20 and 21 is otherwise similar. Thus, referring also to FIG. 8 and FIG. 9 (which shows the longitudinal arrangement of a discontinuous support 21) the downwardly extending leg 17*c* of the cruciform insert 17*a* is welded to the upper edge of a vertical elongate plate 22 which is provided, on either side and at spaced intervals, with vertically extending stiffeners 23, 24 (see FIGS. 8 and 9) The plate 22 and stiffeners are supported on a horizontally extending web plate 25 which, in turn is bolted to a wooden support beam 26. The lower face of the support beam is slidably mounted on a further horizontal web plate 27 which is supported above the floor 28 of the hold via a suitable girder construction 29. Thus the sliding surface permits dimensional changes of the tank due to thermal cycling in use to take place freely in both the longitudinal and transverse directions of the tank. To restrict longitudinal sliding movement of the tank on its support base, the centre support section 21*a* (see FIG. 9) has a stop arrangement located at each end which comprises a bumper pad 30 carried by a suitable girder support arrangement 31. Because the bump pads 30 are located a relatively short distance on each side of the transverse centre line of the tank, dimensional changes at these points due to temperature cycling of the tank in use are minimal. Hence, the gap left between the pads 30 and their respective ends of the section 21*a* will be small. In the case of the continuous supports 20, because there will be an appreciable dimensional change over their length during thermal cycling, no bump pads are provided. Transverse movement of the tank is prevented by the roll keys 35 (described hereinafter) on the tank end walls 5 and 6.

Referring now to FIGS. 10 to 12, for the tank of FIGS. 1 to 5 there is provided a series of aligned roll keys 35 on each end wall 5, 6 at each node point between the intermediate further lobe 11*b* and its adjacent part-lobe 11*c* (see FIG. 12). These keys 35 act via keyways 36 carried by the adjacent transverse bulkhead 37 to restrain the tank against rolling movement of the tanker. Each key 35 is in the form of a tongue (see FIG. 11) which is a sliding fit in a keyway slot defined by a "PERMALI" block 37*a* carried on a suitable support structure 38. It will be noted from FIG. 10 that for each series of keys, the key tongue 35 at the longitudinal centre line of the tank ends is set normal to said centreline, whilst the key tongues 35 which are at increasing distances from the centreline are set at increasing angles. On this point, it will be appreciated that under thermal cycling in use the tank will undergo dimensional changes which are essentially along radial lines emanating from the central point of the tank, and the angles of the tongues and their keyways 36 are set accordingly.

I claim:

1. An internal pressure sustainable tank for the storage and transport of fluid media under pressure comprising, a bottom wall, a top wall, four side walls and an internal framework of plates; each of said bottom, top and two opposed side walls consisting of at least two longitudinally extending parallel lobes, each lobe being of part-cylindrical form ith the same radius of curvature and being convex outwardly of the tank with each of its two inwardly-directed longitudinal edges joined to both a longitudinal edge of a lobe alongside and an edge of a plate of said internal framework; the latter consisting of two orthogonally intersecting series of parallel plates each plate in one series extending from the joint between two lobes of one of said opposed side walls to the respective opposite joint of its opposite side wall, each plate in the other series extending from the joint between two lobes of the bottom wall to the respective opposite joint between two lobes of the top wall, and the plates of at least one of said series extending longitudinally and being also united to oppositely arranged joints of wall components of the other two opposed side walls so that these latter walls are tied to one another longitudinally, the joints at the inter-sections of the two series of plates, the bottom wall lobes and adjacent plates, the top wall lobes and adjacent plates, and the side wall lobes and adjacent plates being formed by elongate insert elements with a number of arms equal to the number of plates they are to connect, the arms being angled to align with the line of said plates, wherein the improvement comprises each one of said other opposed walls consisting of at least two part-lobes of the same radius of curvature, but of appreciably smaller arc than the lobes of said opposed side, top and bottom walls, which part-lobes present straight edges to which the common straight end edges of a series of two-way corner transition and part-transition pieces are joined, these latter pieces having the same radius of curvature as the lobes at their other end edges and being joined at said other ends to respective lobes of an appropriate one of said opposed side walls, and in that the end of each part-lobe has a respective part-transition piece joined thereto to present a curved edge to which a part spherical three-way corner can be joined to close-off the end wall.

2. A tank according to claim 1 characterised in that each one of said other opposed side walls comprises at least one lobe equal in number to the number of intermediate lobes forming said opposed side walls, said further lobes being of the same radius of curvature and arc as the other wall lobes and being joined with a first set of two-way corner pieces, which are in the form of part-spherical knuckles, to corresponding lobes of said opposed side walls so that at least one band of lobes and further lobes extends around the tank in the horizontal plane, and in that said two part-lobes are joined along each outer edge of said further lobe(s), the transition and part-transition pieces thereby forming a second set of two-way corner pieces.

3. A tank according to claim 1, characterised in that the transition and part-transition pieces are joined together via elongate curved insert elements in which there is a smooth transition from being of generally "Y" cross-section at one end to "T" cross-section at the other end.

4. A tank according to claim 1 characterised in that the elongate elements for the joints of the bottom wall have vertical, downwardly extending external legs which provide support elements in a bottom support arrangement for the tank, the outermost elements running continuously along the tank and the inner elements being discontinuous by providing a number of short, aligned sections, said vertical legs being mounted via web plates onto a wooden support beam slidably supported on the tank foundation to cater for dimensional changes in the tank in use, at least a central one of the discontinuous support elements having bump stops provided at the ends of a central short section thereof to restrict sliding movement of a central area of the tank bottom, and hence the complete tank on its foundation.

5. An ocean-going tanker having a plurality of internal pressure sustainable tanks according to claim 1, characterised in that the tanks are aligned longitudinally of the tanker and are separated by transverse bulkheads, said other opposed walls being the end walls of the tanks, in that a series of aligned roll keys/keyways are provided on each end wall at joints between the lobes, in that these keys/keyways fit within respective keyways/keys on the adjacent transverse bulkhead, and in that a key/keyway at the longitudinal centre line of the tank is set normal to said centreline whilst the key/keyways at increasing transverse distances from the centreline are set at increasing angles to cater for dimensional changes of the tank in use emanating along radial lines from the central point of the tank.

* * * * *

UNITED STATES PATENT AND TRADEMARK OFFICE

CERTIFICATE OF CORRECTION

PATENT NO. : 4,459,929

DATED : July 17, 1984

INVENTOR(S) : Roger Cambridge FFOOKS

It is certified that error appears in the above—identified patent and that said Letters Patent is hereby corrected as shown below:

Claim 1, Column 7, Line 34, delete the word "ith" and insert in place thereof the word --with--.

Signed and Sealed this

*Eleventh* Day of *December 1984*

[SEAL]

*Attest:*

GERALD J. MOSSINGHOFF

*Attesting Officer*

*Commissioner of Patents and Trademarks*